US005140836A

United States Patent [19]

Hogan et al.

[11] Patent Number: 5,140,836

[45] Date of Patent: Aug. 25, 1992

[54] THEFT-DETERRENT DEVICE INCLUDING CLAMP

[75] Inventors: Dennis L. Hogan, St. Petersburg; Donald J. Beach, Harbor Bluffs, both of Fla.

[73] Assignee: Security Tag Systems, Inc., St. Petersburg, Fla.

[21] Appl. No.: 762,308

[22] Filed: Sep. 19, 1991

[51] Int. Cl.[5] ..... B65D 55/10

[52] U.S. Cl. ..... 70/57.1; 70/38 A; 70/413; 292/252

[58] Field of Search ..... 70/57.1, 276, 386, 352, 70/38 A, 39, 413; 24/704.1, 459; 292/251.5, 252 X

[56] References Cited

U.S. PATENT DOCUMENTS

| | | | |
|---|---|---|---|
| 652,337 | 6/1900 | Taylor | 70/38 A |
| 1,542,442 | 6/1925 | Fraim | 70/39 |
| 1,543,397 | 6/1925 | Schroeder | 70/39 |
| 1,593,683 | 7/1926 | Anakin | 70/276 |
| 1,662,612 | 3/1928 | Junkunc | 70/55 |
| 3,566,636 | 3/1971 | Rudolf et al. | 70/276 |
| 3,668,681 | 6/1972 | Kaplan | 340/280 |
| 3,858,280 | 1/1975 | Martens | 24/150 R |
| 3,866,205 | 2/1975 | Payne et al. | 340/280 |
| 3,995,900 | 12/1976 | Humble et al. | 70/57.1 |
| 4,012,813 | 3/1977 | Martens et al. | 24/150 R |
| 4,221,025 | 9/1980 | Martens et al. | 24/150 R |
| 4,226,100 | 10/1980 | Hampton et al. | 70/55 |
| 4,317,344 | 3/1982 | Barnard | 70/55 |
| 4,483,049 | 11/1984 | Gustavsson et al. | 24/160 |
| 4,527,310 | 7/1985 | Vandebult | 24/150 R |
| 4,590,461 | 5/1986 | Cooper | 340/572 |
| 4,649,397 | 3/1987 | Heaton et al. | 343/895 |
| 4,651,136 | 3/1987 | Anderson et al. | 340/572 |
| 4,670,950 | 6/1987 | Wisecup et al. | 24/150 R |
| 4,698,620 | 10/1987 | Marshall | 340/568 |
| 4,903,383 | 2/1990 | Gartshore | 24/706.8 |
| 5,022,244 | 6/1991 | Charlot, Jr. | 70/57.1 |
| 5,054,172 | 10/1991 | Hogan et al. | 70/57.1 |

FOREIGN PATENT DOCUMENTS

| | | | |
|---|---|---|---|
| 1928316 | 12/1970 | Fed. Rep. of Germany | 70/276 |
| 12223 | of 1895 | United Kingdom | 70/39 |
| 644006 | 10/1950 | United Kingdom | 70/39 |

*Primary Examiner*—Renee S. Luebke
*Assistant Examiner*—D. Boucher
*Attorney, Agent, or Firm*—Edward W. Callan

[57] ABSTRACT

A clamp for use as a theft deterrent device includes a U-shaped member having first and second legs, with each leg including a shelf disposed on the inside edge of the member and extending laterally toward the opposite leg; a housing defining a pair of longitudinal channels for receiving the legs of the U-shaped member and a slot extending between the longitudinal channels; a pair of overlapping plates disposed for separate movement within the slot into and away from different ones of the longitudinal channels, with each plate including a row of teeth disposed on a longitudinal edge of the one plate that moves into one channel for engaging the shelf on one leg of the U-shaped member received by said one channel to prevent removal of the one leg from the channel. A positioning member is disposed within the housing for forcing one plate to move into one channel and the other plate to move into the other channel such that the teeth of the plates respectively engage the shelves of the legs of the U-shaped member received in the longitudinal channels to prevent removal of the U-shaped member from the housing. The positioning member includes a magnetically attractive element that is movable from a first position to a second position within the housing when attracted by a magnetic field applied in a predetermined direction such that when the magnetically attractive element moves to its second position, the plates are forced to move away from the longitudinal channels sufficiently to disengage the teeth from the shelves so that the U-shaped member can be removed from the housing.

10 Claims, 4 Drawing Sheets

FIG. 2
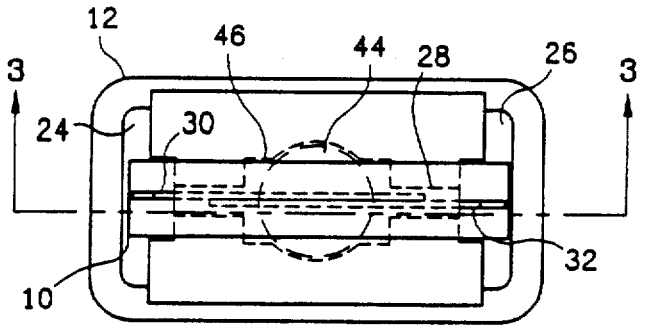
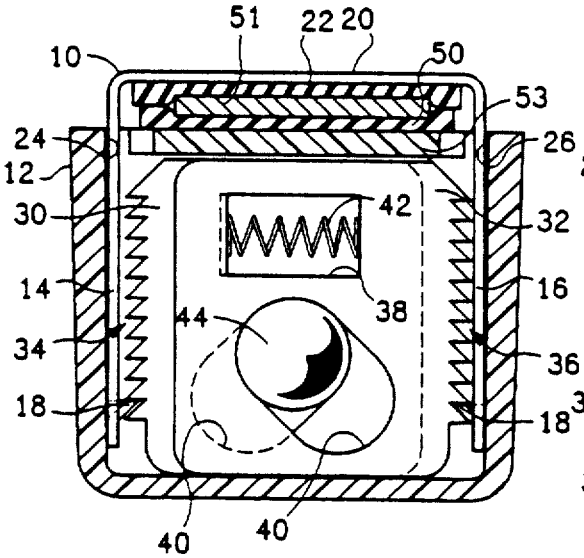
FIG. 3A
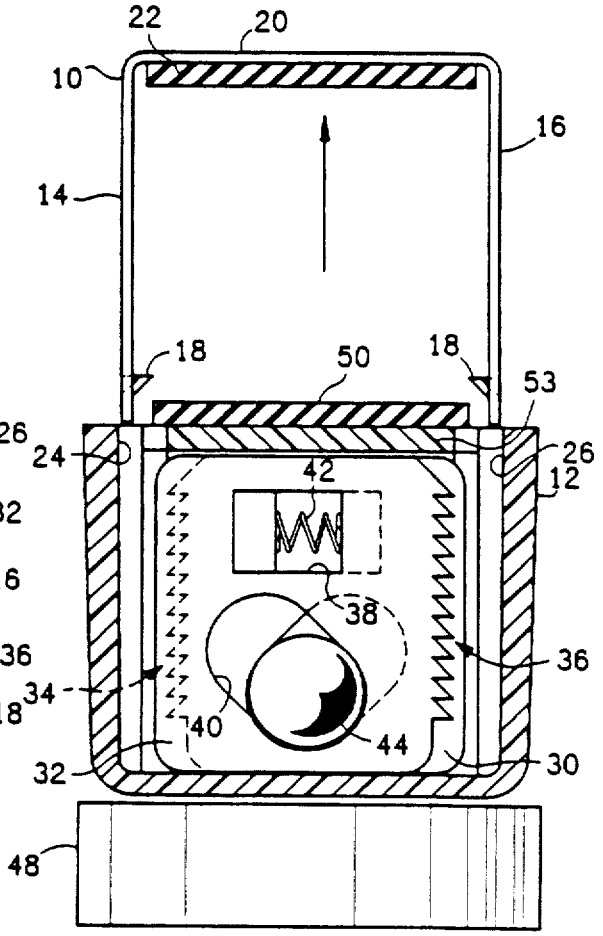
FIG. 3B

THEFT-DETERRENT DEVICE INCLUDING CLAMP

BACKGROUND OF THE INVENTION

The present invention generally pertains to theft deterrent devices and is particularly directed to a clamp that can be attached to merchandise to deter theft of the merchandise.

Theft deterrent devices include transponders that are useful in electronic article surveillance (EAS) systems and vials containing detrimental substances, which vials are contained in tags that are attached to merchandise in such a manner that the vials should fracture if an attempt is made to remove the tag from the merchandise by unauthorized means. Some EAS transponders are also contained in tags that are attached to merchandise. Both EAS-transponder tags and detrimental-substance-containing tags are attached to merchandise by a pin-and-clutch mechanism contained within opposing components of the tag.

However, pin-and-clutch-mechanism tags are not suitable for attachment to some articles of merchandise, such as jewelry.

SUMMARY OF THE INVENTION

The present invention provides a clamp for use as a theft deterrent device that is suitable for attachment to jewelry, such as necklaces, bracelets and watches, as well as other articles of merchandise, such as eyeglasses, to which a clamp is a more suitable means of attachment than a pin-and-clutch mechanism.

The clamp of the present invention includes a U-shaped member having first and second legs, with each leg including a shelf disposed on the inside edge of the member and extending laterally toward the opposite leg; a housing a pair of longitudinal channels for receiving the legs of the U-shaped member; a pair of plates disposed for separate movement within the housing into and away from different ones of the longitudinal channels, with one plate including a row of teeth disposed on a longitudinal edge of the one plate that moves into one channel for engaging the shelf on one leg of the U-shaped member received by said one channel to prevent removal of the one leg from the channel and with the other plate including a row of teeth disposed on a longitudinal edge of the other plate that moves into the other channel for engaging the shelf on the other leg of the U-shaped member received by said other channel to prevent removal of the other leg from the other channel; and positioning means disposed within the housing for forcing one plate to move into one channel and the other plate to move into the other channel such that the teeth of the plates respectively engage the shelves of the legs of the U-shaped member received in the longitudinal channels to prevent removal of the U-shaped member from the housing; wherein the positioning means include a magnetically attractive element that is movable from a first position to a second position within the housing when attracted by a magnetic field applied in a predetermined direction such that when the magnetically attractive element moves to its second position, the plates are forced to move away from the longitudinal channels sufficiently to disengage the teeth from the shelves so that the U-shaped member can be removed from the housing.

Preferably, the U-shaped member includes a bar extending between the legs to define the closed end of the U, with the bar including a compressible material on the inside edge of the member; and the housing includes a compressible material on a surface that faces the bar when the U-shaped member is received by the housing. The compressible material enables the clamp to tightly grip an article of merchandise received between the bar and housing without damaging the merchandise. The compressible material also facilitates disengagement of the teeth from the shelves in response to pressure applied on the bar of the U-shaped member to move bar toward the housing while the magnetic field is being applied to move the magnetically attractive element.

The clamp may further contain a transponder for an electronic article surveillance system, with the transponder being attached to either the U-shaped member or the housing, and/or a vial containing a detrimental substance, with the vial being attached to either the U-shaped member or the housing in such a manner that the vial may fracture if an attempt is made to remove the U-shaped member from the housing by means other than application of a magnetic field.

The clamp itself, without having either an EAS transponder or a detrimental-substance-containing vial attached thereto, is useful as theft deterrent device because its mere attachment to the merchandise presents the problem of removal to the potential thief.

Additional features of the present invention are described in relation to the description of the preferred embodiments.

BRIEF DESCRIPTION OF THE DRAWING

FIG. 2 is a top view the clamp of FIG. 1 as assembled, and with certain interior features thereof shown by dashed lines.

FIG. 3A is a sectional view taken along lines 3—3 in FIG. 2 that illustrates the operation of the clamp with the plates being positioned to engage the teeth with the shelves of the U-shaped member.

FIG. 3B is a sectional view taken along lines 3—3 in FIG. 2 that illustrates the operation of the clamp with the plates being positioned to disengage the teeth from the shelves of the U-shaped member.

DESCRIPTION OF THE PREFERRED EMBODIMENTS

Figure 1:
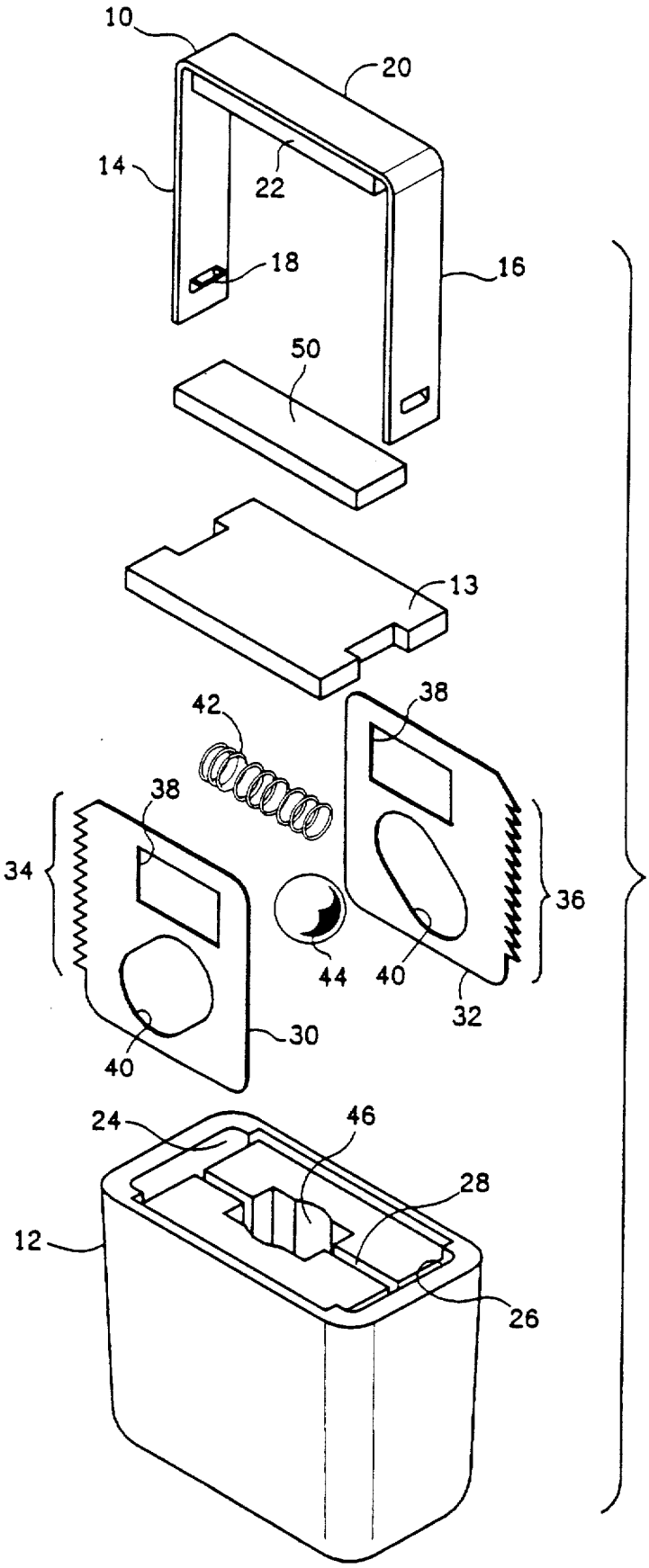
FIG. 1 is an exploded perspective view of one preferred embodiment of the clamp of the present invention.

Referring to FIGS. 1, 2, 3A and 3B, one preferred embodiment of a clamp according to the present invention includes a U-shaped member 10 and a housing 12 having a top cover 13.

The U-shaped member 10 has a first leg 14 and a second leg 16. Each leg includes a shelf 18 disposed on the inside edge of the member 10 and extending laterally toward the opposite leg. The U-shaped member 10 is made of stainless steel. The shelves 18 are formed by punching through portions of the legs 14, 16. Alternatively, the shelves may be formed by bending up the ends of the legs 14, 16.

The member 10 further includes a bar 20 extending between the legs 14, 16 to define the closed end of the U. A compressible material pad 22, such as a rubber pad, is attached to the bar on the inside edge of the member 10.

The housing 12 defines a pair of longitudinal channels 24, 26 for receiving the legs 14, 16 of the U-shaped member 10 and a slot 28 extending between the longitudinal channels 24, 26.

A pair of overlapping flat plates 30, 32 are disposed in the housing 12 for separate movement within the slot 28 into and away from different ones of the longitudinal channels 24, 26. One plate 30 includes a row of sawteeth 34 disposed on an edge of the plate 30 that moves into the channel 24 for engaging the shelf 18 on one leg of the U-shaped member received by the channel 24 to prevent removal of the one leg from the channel 24; and the other plate 32 includes a row of sawteeth 36 disposed on an edge of the plate 32 that moves into the channel 26 for engaging the shelf 18 on the other leg of the U-shaped member received by the channel 26 to prevent removal of the other leg from the channel 26. The plates 30, 32 are made of stainless steel.

Each plate 30, 32 contains a lateral rectangular window 38 that overlaps the lateral rectangular window in the other plate when the plates move within the slot 28 and an oblique oblong window 40 that overlaps the oblique oblong window in the other plate at a cross angle of ninety degrees when the plates move within the slot 28.

A contracted coil spring 42 is laterally disposed within the overlapping lateral windows 38 for forcing one plate 30 to move into one channel 24 and the other plate 32 to move into the other channel 26 such that the teeth 34, 36 of the plates 30, 32 respectively engage the shelves 18 of the legs of the U-shaped member received in the longitudinal channels 24, 26 to prevent removal of the U-shaped member 10 from the housing 12.

A steel ball 44 that is magnetically attractive is disposed within the overlapping oblique oblong windows 40 for movement within a chamber 46 defined by the housing 12. The ball 44 is movable from a first position as shown in FIG. 3A to a second position as shown in FIG. 3B when attracted by a magnetic field applied in the longitudinal direction by a high strength magnet 48 positioned beneath the housing 12 such that when the ball 44 moves to its second position (FIG. 3B), the plates 30, 32 are forced by the ball 44 to move away from the longitudinal channels sufficiently to disengage the teeth from the shelves so that the U-shaped member can be removed from the housing. In the absence of a properly applied magnetic field, the force of the spring 42 is such as to force the plates 30, 32 to the position shown in FIG. 3A, wherein the ball 44 resides in its first position.

A compressible material pad 50, such as rubber, is attached to the top surface of the cover 13 of the housing 12. Ridges (not shown) may be provided on the surfaces of the compressible material pads 22, 50 that grip the article of merchandise 51 that is to be protected from theft.

Following assembly of the clamp, the cover 13 is permanently secured to the housing 12 by glue or ultrasonic welding.

In operation, the article of merchandise 51 is placed within the U of the U-shaped member 10 as the U-shaped member 10 is inserted into the housing 12. During insertion, the shelves 18 on the legs 14, 16 of the U-shaped member ratchet past the teeth 34, 36 of the plates 30, 32 as the plates are temporarily moved away from the the longitudinal channels 24, 26 by the force applied to the plates by the shelves 18. When further insertion of the U-shaped member 10 is prevented by the dimension of the article of merchandise that has been placed within the U, the compressible material pads 22 and 50 on the bar 20 and housing 12 is compressed until the shelves 18 are engaged by teeth on the respective legs 14 and 18 to prevent removal of the U-shaped member 10 to the housing 12. The article of merchandise 51 is tightly clamped between the compressible material pad 22 on U-shaped member 10 and the compressible material pad 50 on the housing 12 so that such article cannot be removed from the clamp unless the U-shaped member 10 is removed from the housing 12. The ridges (not shown) on the compressible material pads 22, 50 help to prevent the article 51 from being pulled through the clamp. The compressible material pads 22, 50 are compressed to maintain the tension of the clamping action.

To remove the clamp from the article of merchandise 51, a high strength magnet 48 is positioned beneath the housing 12 to apply a magnetic field that moves the ball 44 to its second position within the housing 12 so that the ball 44 forces the plates 30, 32 to move away from the longitudinal channels 24, 26 so that the shelves 18 become disengaged from the teeth 34, 36 so that the U-shaped member 10 can be pulled from the housing 12. Disengagement of the shelves 18 from the teeth 34, 36 is facilitated by applying pressure on the bar 20 toward the housing 12 through the compressible material pads 22, 50 to relieve the friction between the shelves 18 and the teeth 34, 36 as the magnetic field is being applied.

Figure 4A:
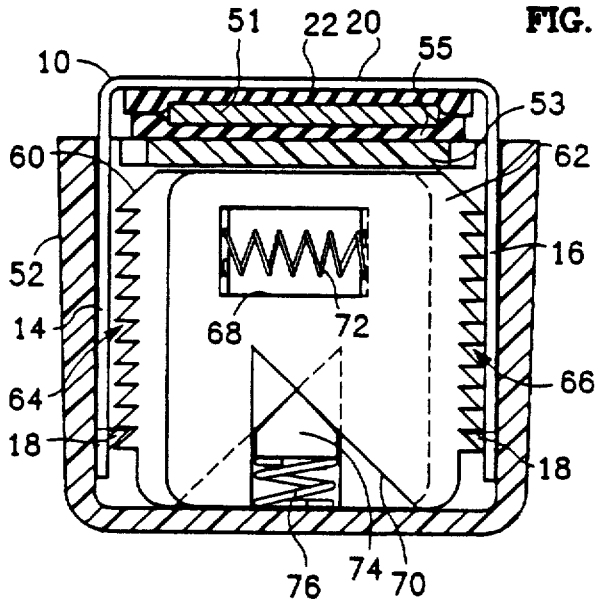
FIG. 4A is a sectional view of an alternative embodiment of the clamp that illustrates the operation of the clamp with the plates being positioned to engage the teeth with the shelves of the U-shaped member.
Figure 4B:
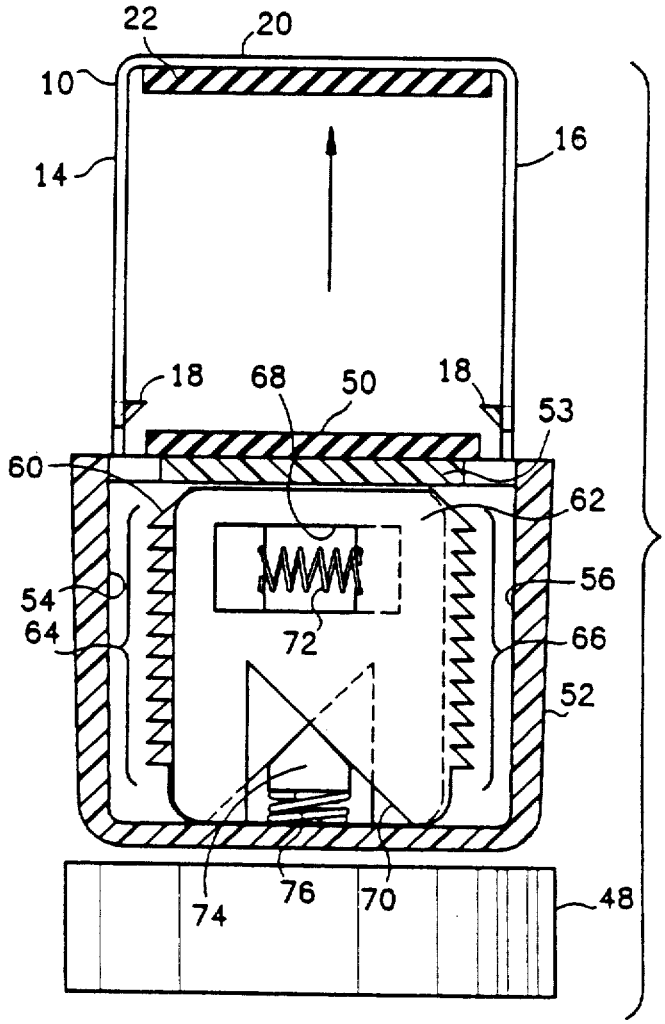
FIG. 4B is a sectional view of the alternative embodiment of FIG. 4A that illustrates the operation of the clamp with the plates being positioned to disengage the teeth from the shelves of the U-shaped member.

Referring to FIGS. 4A and 4B, an alternative preferred embodiment of the clamp of the present invention includes a U-shaped member as described above and a housing 52 having a top cover 53. A compressible material pad 55, such as rubber, is attached to the top surface of the cover 53.

The housing 52 defines a pair of longitudinal channels 54, 56 for receiving the legs 14, 16 of the U-shaped member 10 and a slot extending between the longitudinal channels 54, 56.

A pair of overlapping flat plates 60, 62 are disposed in the housing 52 for separate movement within the slot into and away from different ones of the longitudinal channels 54, 56. One plate 60 includes a row of sawteeth 64 disposed on an edge of the plate 60 that moves into the channel 54 for engaging the shelf 18 on one leg 14 of the U-shaped member received by the channel 54 to prevent removal of the one leg 14 from the channel 54; and the other plate 62 includes a row of sawteeth 66 disposed on an edge of the plate 62 that moves into the channel 56 for engaging the shelf 18 on the other leg 16 of the U-shaped member received by the channel 56 to prevent removal of the other leg 16 from the channel 56. The plates 60, 62 are made of stainless steel.

Each plate 60, 62 contains a lateral rectangular window 68 that overlaps the lateral rectangular window in the other plate when the plates move within the slot and an oblique edge 70 that overlaps the angular edge of the other plate at a cross angle of ninety degrees when the plates move within the slot.

An extended first coil spring 72 is disposed within the overlapping lateral windows 68 and attached to the respective plates 60, 62 at the lateral ends of the windows 68 for forcing the plates to move away from the longitudinal channels 54, 56 sufficiently to disengage the teeth 64, 66 from the shelves 18 so that the U-shaped member 10 can be removed from the housing 52.

A wedge 74 is disposed against the oblique edges 70 of the plates 60, 62 where the oblique edges overlap at a cross angle.

A contracted second coil spring 76 is disposed against the wedge 74 for forcing the wedge 74 against the oblique edges 70 of the plates 60, 62 with sufficient strength to overcome the first spring 72 and force one plate 60 to move into one channel 54 and the other plate 62 to move into the other channel 56 such that the teeth 64, 66 of the plates respectively engage the shelves 18 of the legs 14, 16 of the U-shaped member 10 received in the longitudinal channels 54, 56 to prevent removal of the U-shaped member from the housing 52.

The wedge 74 is made of steel that is magnetically attractive and disposed for movement within a chamber 78 defined by the housing 52. The wedge 74 is movable toward the second spring 76 from a first position as shown in FIG. 4A to a second position as shown in in FIG. 4B when attracted by a magnetic field applied in the longitudinal direction by a high strength magnet 48 positioned beneath the housing 52 such that when the wedge 74 moves to its second position (FIG. 4B), the force applied by wedge 74 to the plates 60, 62 is insufficient to overcome the first spring 72 and the plates 60, 62 are forced by the first spring 72 to move away from the longitudinal channels 54, 56 sufficiently to disengage the teeth 64, 66 from the shelves 18 so that the U-shaped member 10 can be removed from the housing 52.

Following assembly of the clamp, the cover 53 is permanently secured to the housing 52 by glue or ultrasonic welding.

In other respects the clamp described with reference to FIGS. 4A and 4B is operated in the same manner as the clamp described with reference to FIGS. 1, 2, 3A and 3B.

Figure 5A:
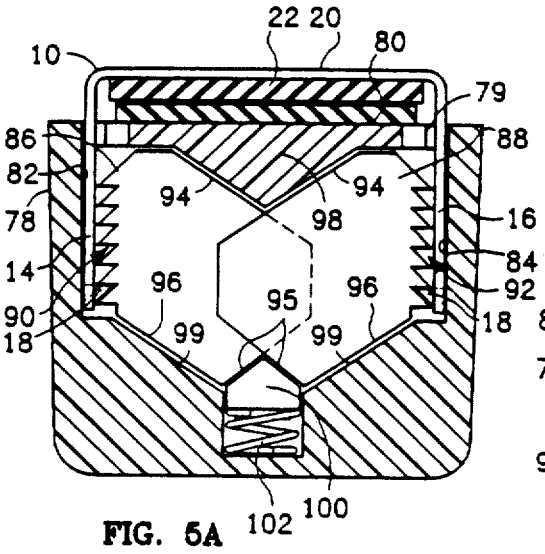
FIG. 5A is a sectional view of another alternative embodiment of the clamp that illustrates the operation of the clamp with the plates being positioned to engage the teeth with the shelves of the U-shaped member.
Figure 5B:
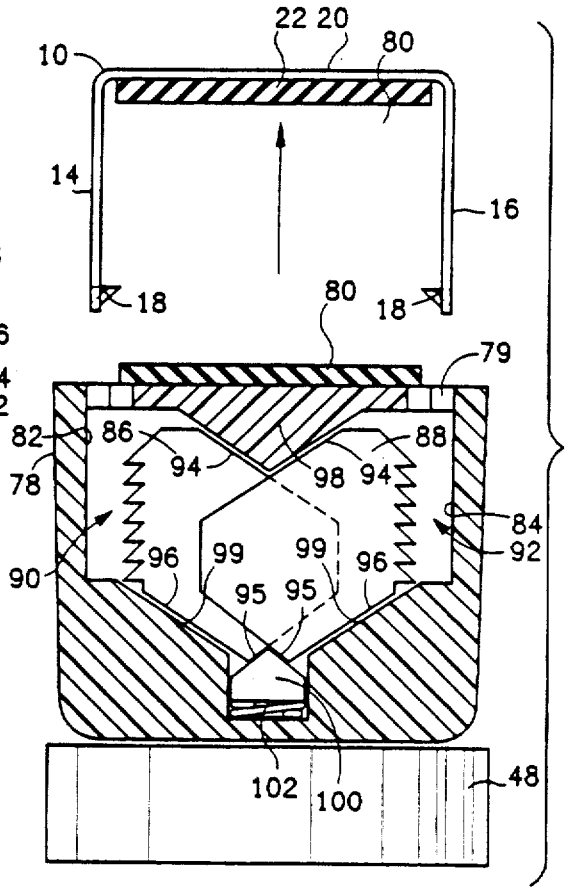
FIG. 5B is a sectional view of the alternative embodiment of FIG. 5A that illustrates the operation of the clamp with the plates being positioned to disengage the teeth from the shelves of the U-shaped member.

Referring to FIGS. 5A and 5B, another alternative preferred embodiment of the clamp of the present invention includes a U-shaped member as described above and a housing 78 having a top cover 79. A compressible material pad 80, such as rubber, is attached to the top surface of the cover 79.

The housing 78 defines a pair of longitudinal channels 82, 84 for receiving the legs 14, 16 of the U-shaped member 10 and a slot extending between the longitudinal channels 82, 84.

A pair of overlapping flat plates 86, 88 are disposed in the housing 78 for separate movement within the slot into and away from different ones of the longitudinal channels 82, 84. One plate 86 includes a row of sawteeth 90 disposed on an edge of the plate 86 that moves into the channel 82 for engaging the shelf 18 on one leg 14 of the U-shaped member received by the channel 82 to prevent removal of the one leg 14 from the channel 82; and the other plate 88 includes a row of sawteeth 92 disposed on an edge of the plate 88 that moves into the channel 84 for engaging the shelf 18 on the other leg 16 of the U-shaped member received by the channel 84 to prevent removal of the other leg 16 from the channel 84. The plates 86, 88 are made of a magnetically attractive steel.

Each plate 86, 88 contains an upper oblique edge 94 that overlaps the upper oblique edge 94 of the other plate at a cross angle when the plates within the slot, a first lower oblique edge 95 that overlaps the first lower oblique edge 95 of the other plate at a cross angle when the plates move within the slot, and a second lower oblique edge 96 extending upward from the first lower oblique edge toward the lower end of the teeth bearing edge of the plate.

A first wedge 98 defined by the bottom surface of top cover 79 of the housing 78 is disposed against the upper oblique edges 94 of the plates 86, 88 where the upper oblique edges overlap at a cross angle so that the plates are guided by the first wedge 98 to move into and away from the longitudinal channels 82, 84.

A second wedge 100 is disposed against the first lower oblique edges 95 of the plates 86, 88 where the first lower oblique edges overlap at a cross angle.

A pair of ramps 99 defined by the housing 78 are respectively disposed against the second lower oblique edges 96 of the plates 86, 88 so that the plates are guided by the ramps 100 to move into and away form the longitudinal channels 82, 84.

A spring 102 is disposed against the second wedge 100 for forcing the second wedge 100 against the first lower oblique edges 95 of the plates 86, 88 to thereby force the upper oblique edges 94 against the first wedge 98 so that one plate 86 moves into one channel 82 and the other plate 88 moves into the other channel 84 such that the teeth 90, 92 of the plates 86, 88 respectively engage the shelves 18 of the legs 14, 16 of the U-shaped member 10 received in the longitudinal channels 82, 84 to prevent removal of the U-shaped member from the housing 78.

The second wedge 100 is made of steel that is magnetically attractive and is movable toward the second spring 102 from a first position as shown in FIG. 5A to a second position as shown in FIG. 5B when attracted by a magnetic field applied in the longitudinal direction by a high strength magnet positioned beneath the housing 48, such that when the second wedge 100 moves to its second position (FIG. 5A), the second wedge 100 magnetically attracts the plates to force the second lower oblique edges 96 of the plates 86, 88 against the ramps 99 and pull the plates away from the longitudinal channels 82, 84 sufficiently to disengage the teeth 90, 92 from the shelves 18 so that the U-shaped member 10 can be removed from the housing 78.

Following assembly of the clamp, the cover 79 is permanently secured to the housing 78 by glue or ultrasonic welding.

In other respects the clamp described with reference to FIGS. 5A and 5B is operated in the same manner as the clamp described with reference to FIGS. 1, 2, 3A and 3B.

In other alternative preferred embodiments (not shown), leaf springs may be substituted for coil springs and/or separate mechanisms can be provided for independently positioning the plates, wherein each plate is disposed within a separate slot and separate springs and balls are used for positioning the separate plates. In such alternative embodiments, the windows for the balls may disposed longitudinally rather than at oblique angles as shown in FIGS. 1, 3A and 3B. Also the window for the ball(s) can be replaced by bending part of the plate at an angle of ninety degrees, with the ball riding against the bent portion. Alternatively, when a large leaf spring is used the ball can ride obliquely and push against the leaf spring. In another alternative preferred embodiment, two parallel sets of the positioning mechanisms shown in FIGS. 1, 2, 3A and 3B can be used to provide greater strength and stability.

Figure 6:
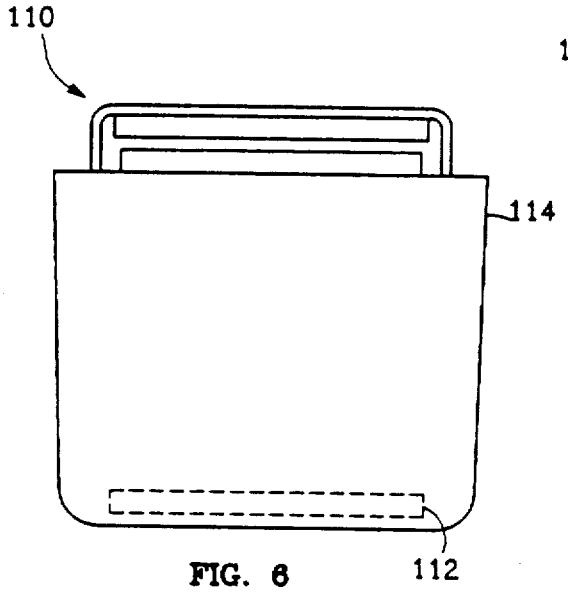
FIG. 6 illustrates a clamp having an EAS transponder enclosed within the housing.

Referring to FIG. 6, a clamp 110 according to the present invention, as described above, has an EAS transponder 112 enclosed within the housing 114 of the clamp 110. A preferred EAS transponder 112 for enclosure in the clamp 110 is described in U.S. Pat. No. 4,670,740 to Fred Wade Herman and Lincoln H. Charlot, Jr.

Figure 7:
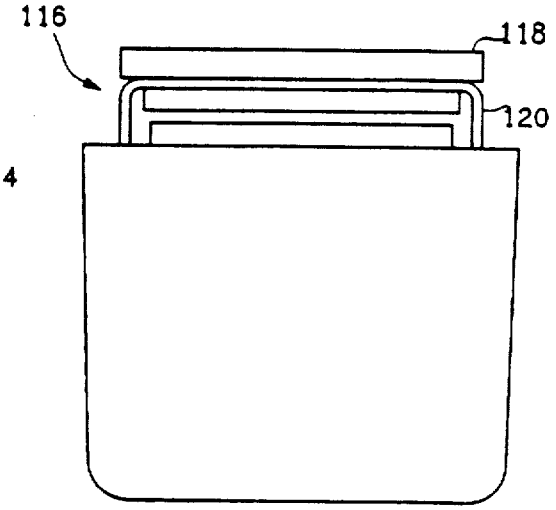
FIG. 7 illustrates a clamp having a tag including a detrimental-substance-containing vial attached to the U-shaped member.

Referring to FIG. 7, a clamp 116 according to the present invention, as described above, has a tag 118 including a detrimental-substance-containing vial attached to the U-shaped member 120 of the clamp 116. A preferred tag including a detrimental-substance-containing vial is described in U.S. patent application Ser. No. 07/602,818 filed Oct. 25, 1990 issued Oct. 8, 1991 as U.S. Pat. No. 5,054,172 to Dennis L. Hogan, John L. Lynch and Lincoln H. Charlot, Jr.

We claim:

1. A clamp, comprising a U-shaped member having first and second legs, with each leg including a shelf disposed on the inside edge of the member and extending laterally toward the opposite leg;

a housing defining a pair of longitudinal channels for receiving the legs of the U-shaped member and a slot extending between the longitudinal channels;

a pair of plates disposed within the slot for separate overlapping movement into and away from different ones of the longitudinal channels, with one plate including a row of teeth disposed on an edge of the one plate that moves into one channel for engaging the shelf on one leg of the U-shaped member received by said one channel to prevent removal of the one leg from the one channel and with the other plate including a row of teeth disposed on an edge of the other plate that moves into the other channel for engaging the shelf on the other leg of the U-shaped member received by said other channel to prevent removal of the other leg from the other channel, wherein each plate includes an oblique edge that overlaps the oblique edge of the other plate at a cross angle when the plates move within the slot; and positioning means disposed within the housing for forcing one plate to move into one channel and the other plate to move into the other channel such that the teeth of the plates respectively engage the shelves of the legs of the U-shaped member received in the longitudinal channels to prevent removal of the U-shaped member from the housing;

wherein the positioning means include a magnetically attractive element that is movable from a first position to a second position within the housing when attracted by a magnetic field applied in a predetermined direction such that movement of the magnetically attractive element to its second position causes forces to be applied to the oblique edges of the plates to force the plates to move away from the longitudinal channels sufficiently to disengage the teeth from the shelves so that the U-shaped member can be removed from the housing.

2. A clamp according to claim 1, wherein each plate contains a lateral window that overlaps the lateral window in the other plate when the plates move within the slot and an oblique oblong window having said oblique edge that overlaps the oblique oblong window in the other plate at a cross angle when the plates move within the slot; and wherein the positioning means include a spring laterally disposed within the overlapping lateral windows for forcing one plate to move into one channel and the other plate to move into the other channel such that the teeth of the plates respectively engage the shelves of the legs of the U-shaped member received in the longitudinal channels to prevent removal of the U-shaped member from the housing; and the magnetically attractive element disposed within the overlapping oblique oblong windows for movement within the housing from a first position to a second position when attracted by a magnetic field applied in the predetermined direction such that when the magnetically attractive element moves to its second position, the plates are forced by the magnetically attractive element to move away from the longitudinal channels sufficiently to disengage the teeth from the shelves so that the U-shaped member can be removed from the housing.

3. A clamp according to claim 2, wherein the magnetically attractive element is a ball.

4. A clamp according to claim 1, wherein each plate contains a lateral window that overlaps the lateral window in the other plate when the plates move within the slot; and wherein the positioning means include a first spring disposed within the overlapping lateral windows and attached to the respective plates for forcing the plates to move away from the longitudinal channels sufficiently to disengage the teeth from the shelves so that the U-shaped member can be removed from the housing;

a wedge disposed against the oblique edges of the plates where the angular edges overlap at a cross angle; and a second spring disposed against the wedge for forcing the wedge against the oblique edges of the plates with sufficient strength to overcome the first spring and force one plate to move into one channel and the other plate to move into the other channel such that the teeth of the plates respectively engage the shelves of the legs of the U-shaped member received in the longitudinal channels to prevent removal of the U-shaped member from the housing;

wherein the wedge includes the magnetically attractive element and is movable toward the second spring from a first position to a second position within the housing when attracted by a magnetic field applied in the predetermined direction such that when the wedge moves to its second position, the force applied by wedge to the plates is insufficient to overcome the first spring and the plates are forced by the first spring to move away from the longitudinal channels sufficiently to disengage the teeth from the shelves so that the U-shaped member can be removed from the housing.

5. A clamp according to claim 1, wherein each plate includes a magnetically attractive element and contains an upper oblique edge that overlaps the upper oblique edge of the other plate at a cross angle when the plates move within the slot, a first lower oblique edge tht overlaps the first lower oblique edge of the other plate at a cross angle when the plates move within the slot, and a second lower oblique edge extending upward from the first lower oblique edge toward the lower end of the teeth bearing edge of the plate;

wherein the positioning means include a first wedge disposed against the upper oblique edges of the plates where the upper oblique edges overlap at a cross angle so that the plates are guided by the first wedge to move into and away from the longitudinal channels;

a second wedge disposed against the first lower oblique edges of the plates where the first lower oblique edges overlap at a cross angle;

a pair of ramps respectively disposed against the second lower oblique edges of the plates so that the plates are guided by the ramps to move into and away form the longitudinal channels;

a spring disposed against the second wedge for forcing the second wedge against the first lower oblique edges of the plates to thereby force the upper oblique edges against the first wedge so that one plate moves into one channel and the other plate moves into the other channel such that the teeth of the plates respectively engage the shelves of the legs of the U-shaped member received in the longitudinal channels to prevent removal of the U-shaped member from the housing;

wherein the second wedge includes the magnetically attractive element and is movable toward the spring from a first position to a second position within the housing when attracted by a magnetic field applied in the predetermined direction such that when the second wedge moves to its second position, the second wedge magnetically attracts the plates to force the second lower oblique edges of the plates against the ramps and pull the plates away from the longitudinal channels sufficiently to disengage the teeth from the shelves so that the U-shaped member can be removed from the housing.

6. A clamp according to claim 1, wherein the U-shaped member includes a bar extending between the legs to define the closed end of the U, with the bar including a compressible material on the inside edge of the member; and wherein the housing includes a compressible material on a surface that faces the bar when the U-shaped member is received by the housing.

7. A clamp according to claim 6, further comprising a transponder for an electronic article surveillance system, with the transponder being attached to either the U-shaped member or the housing.

8. A clamp according to claim 6, further comprising a vial containing a detrimental substance, with the vial being attached to either the U-shaped member or the housing in such a manner that the vial may fracture if an attempt is made to remove the U-shaped member from the housing by means other than application of a magnetic field.

9. A clamp according to claim 1, further comprising a transponder for an electronic article surveillance system, with the transponder being attached to either the U-shaped member or the housing.

10. A clamp according to claim 1, further comprising a vial containing a detrimental substance, with the vial being attached to either the U-shaped member or the housing in such a manner that the vial may fracture if an attempt is made to remove the U-shaped member from the housing by means other than application of a magnetic field.

* * * * *